US007552695B1

(12) United States Patent
Matsueda et al.

(10) Patent No.: US 7,552,695 B1
(45) Date of Patent: Jun. 30, 2009

(54) ROWING BOAT FOOTREST ASSEMBLY

(75) Inventors: Keiji Matsueda, Osaka (JP); Yasushi Nakamura, Osaka (JP); Masahiro Ohkoshi, Osaka (JP)

(73) Assignee: Shimano Inc., Osaka (JP)

( * ) Notice: Subject to any disclaimer, the term of this patent is extended or adjusted under 35 U.S.C. 154(b) by 6 days.

(21) Appl. No.: 12/031,931

(22) Filed: Feb. 15, 2008

(51) Int. Cl.
*B63B 17/00* (2006.01)

(52) U.S. Cl. ..... 114/363

(58) Field of Classification Search ..... 114/153, 114/343, 347, 363; 280/250.1, 291, 304.1; 440/104, 105, 106
See application file for complete search history.

(56) References Cited

U.S. PATENT DOCUMENTS 1,621,423 A * 3/1927 Long ..... 114/363
3,898,950 A * 8/1975 Martin ..... 440/105
4,649,852 A * 3/1987 Piantedosi ..... 114/363
5,367,976 A 11/1994 Van Schaik
5,899,780 A * 5/1999 Robbins ..... 440/105
2006/0183385 A1 8/2006 Kaufer
2006/0292940 A1 12/2006 Ewans

FOREIGN PATENT DOCUMENTS

DE 9309887 U 8/1993
DE 4324864 A1 1/1995

* cited by examiner

*Primary Examiner*—Lars A Olson
(74) *Attorney, Agent, or Firm*—Global IP Counselors, LLP

(57) ABSTRACT

A rowing boat footrest assembly includes a stationary footrest surface coupled to a boat structure, a first shoe attachment portion and a second shoe attachment portion. The first shoe attachment portion is supported to the footrest surface for releasably retaining a first shoe for pivotal movement about a first pivot axis relative to the footrest surface. The second shoe attachment portion is supported to the footrest surface for releasably retaining a second shoe for pivotal movement about a second pivot axis relative to the footrest surface. The first pivot axis and second pivot axis are co-planar and angularly offset from one another.

16 Claims, 11 Drawing Sheets

ROWING BOAT FOOTREST ASSEMBLY

BACKGROUND OF THE INVENTION

1. Field of the Invention

This invention generally relates to a rowing boat footrest assembly that supports a rower's shoes. More specifically, the present invention relates to a rowing boat footrest assembly configured to allow attached rower's shoes to pivot relative to the rowing boat footrest assembly.

2. Background Information

Rowing is becoming an increasingly more popular form of recreation. Moreover, rowing has become a very popular competitive sport for both amateurs and professionals. Whether rowing is for recreation or competition, the rowing industry is constantly improving the various components of rowing boats and equipment used by rowing enthusiasts. One component that has been extensively redesigned is the rowing boat footrest.

Traditionally, the footrest in a rowboat is an angled surface upon which a rower can brace his or her feet to provide increased power during the rowing process. Recently, footrests have been provided with simple shoe retaining straps or mechanisms that hold a rower's shoe against the surface of the footrest. However, there is a problem with such structures in that the rowers shoe and foot are fixed in place and cannot move or pivot with the motion of the rower during the rowing back and forth stroke.

In view of the above, it will be apparent to those skilled in the art from this disclosure that there exists a need for an improved footrest configuration that allows for movement of a rower's foot relative to a footrest. This invention addresses this need in the art as well as other needs, which will become apparent to those skilled in the art from this disclosure.

SUMMARY OF THE INVENTION

One object of the present invention is to provide a footrest assembly for a rowing boat with structure that allows the rower's shoes to pivot during the rowing motions.

Another object of the present invention is to provide a footrest assembly for a rowing boat with structure that secures the rower's shoes to the footrest assembly but allows for ergonomic pivoting movement of the rower's shoes.

The foregoing objects can basically be attained by providing a rowing boat footrest assembly with a stationary footrest surface, a first shoe attachment portion and a second shoe attachment portion. The stationary footrest surface is coupled to a boat structure. The first shoe attachment portion is supported to the footrest surface for releasably retaining a first shoe for pivotal movement about a first pivot axis relative to the footrest surface. The second shoe attachment portion is supported to the footrest surface for releasably retaining a second shoe for pivotal movement about a second pivot axis relative to the footrest surface, with the first pivot axis and second pivot axis being co-planar and angularly offset from one another.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
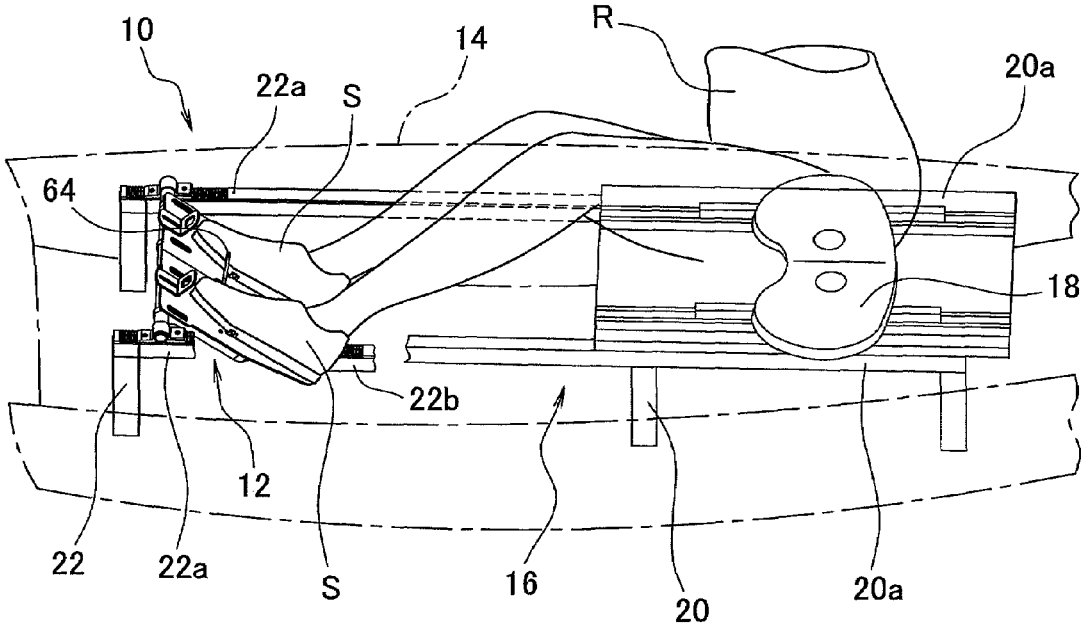
FIG. 1 is a perspective view showing a portion of a hull of a rowing boat showing a footrest assembly and a rower with rower's shoes placed on a portion of the footrest assembly in a rowing position in accordance with the present invention.

Referring initially to FIG. 1, a rowing boat 10 that includes a footrest assembly 12 is illustrated in accordance with a first embodiment. A portion of the rowing boat 10 is depicted in FIG. 1. The rowing boat 10 can be any of a variety of boat where one or more persons is seated for rowing the boat. For example, the rowing boat 10 can be a sweep-oar rowing boat where each rower has one oar held by both hand. Alternatively, the rowing boat 10 can be a sculling rowing boat where each rower has two oars, one oar held by each hand. The conventional oars of the rowing boat 10 are omitted for the sake of brevity and to provide greater clarity in the drawings. The rowing boat 10 also includes a hull 14 (only a portion of the hull 14 is shown in FIG. 1), a support structure 16 and a seat 18.

The hull 14 can have any of a variety of conventional shapes and configurations depending upon whether the boat is a sweep-oar rowing boat or a sculling rowing boat. More specifically, the size and shape of the hull 14 can have any size and shape that can accommodate the footrest assembly 12. The support structure 16 is a conventional structure that is rigidly fixed to or rigidly supported to the interior of the hull 14 or gunwale portion of the hull 14. The support structure 16 includes a seat support portion 20 and a footrest assembly support portion 22.

It should be understood from the drawings and the description herein that the support structure 16 can be a single structure supported by and/or rigidly fixed to the hull 14, or alternatively can be two or more separated structures that are supported or rigidly fixed to the hull 14.

The seat support portion 20 includes a pair of parallel rails 20*a* disposed on either side of the hull 14 that support the seat 18. The seat 18 includes bearing portions such as rolling wheels or bushing surfaces that allow the seat 18 to slide smoothly fore and aft relative to the hull 14 along the parallel rails 20*a*.

The footrest assembly support portion 22 includes a pair of side rails 22*a* and a middle rail 22*b*. The side rails 22*a* are preferably arranged parallel to one another along the sides of the hull 14. The side rails 22*a* can be extensions of the parallel rails 20*a* or can be separate elements that extend in-line with or parallel to the parallel rails 20*a*. The middle rail 22*b* can be centered along the floor of the hull 14. In the depicted embodiment, the middle rail 22*b* is equidistant from the side rails 22*a*, but is lower that the side rails 22*a*.

When seated in the seat 18, a rower R can put his or her feet on the footrest assembly 12 and use the footrest assembly 12 as leverage to assist in rowing the rowing boat 10.

Figure 2:
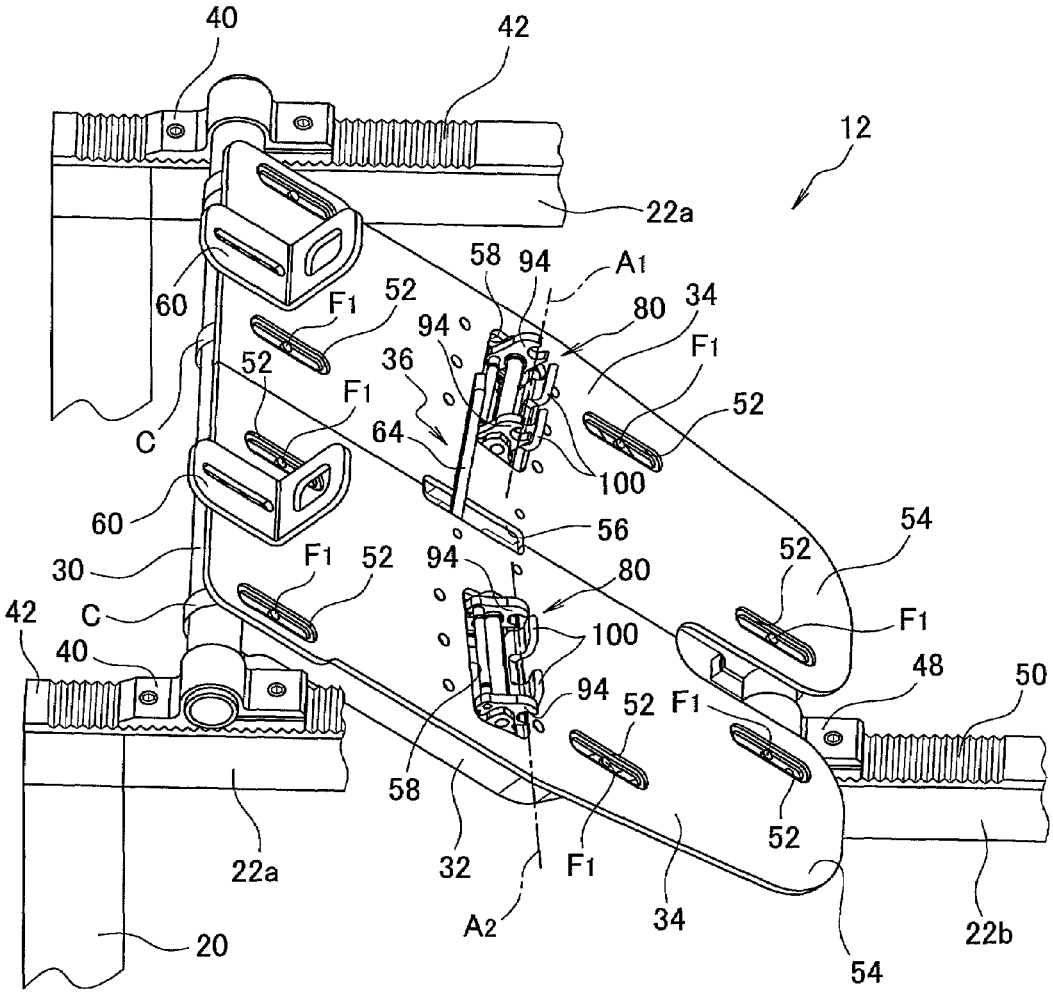
FIG. 2 is a perspective view of the footrest assembly shown with portions of the hull of the rowing boat removed showing features of the footrest assembly including shoe attachment portions in accordance with the present invention.

With specific reference to FIGS. 2-12, a description of the footrest assembly 12 is now provided. As best shown in FIG. 2, the footrest assembly 12 basically includes a lateral support member 30, an inclined support member 32, a pair of footrest plates 34 and a lever release mechanism 36.

The lateral support member 30 extends laterally relative to the rowing boat 10 between sides of the hull 14. The lateral support member 30 includes gripping blocks 40 that engage tracks 42 that are rigidly fixed on respective upper surfaces of the side rails 22*a* of the footrest assembly support portion 22 of the support structure 16. The gripping blocks 40 and the tracks 42 include mating gear teeth configured such that the lateral support member 30 can be selectively position along the side rails 22*a*. For example, a taller rower may want the footrest assembly 12 moved to a forward position closer to the bow of the rowing boat 10. Shorter rower may want to move the footrest assembly 12 to a more rearward position toward the stern of the rowing boat 10.

Once positioned, the mating gear teeth of the gripping blocks 40 and the engage tracks 42 help to maintain the footrest assembly 12 in the selected position. Although not shown, the gripping blocks 40 can further include clamping elements or fasteners for selectively securing the gripping blocks 40 to the side rails 22*a* once the footrest assembly 12 is positioned in the desired location.

Figure 10:
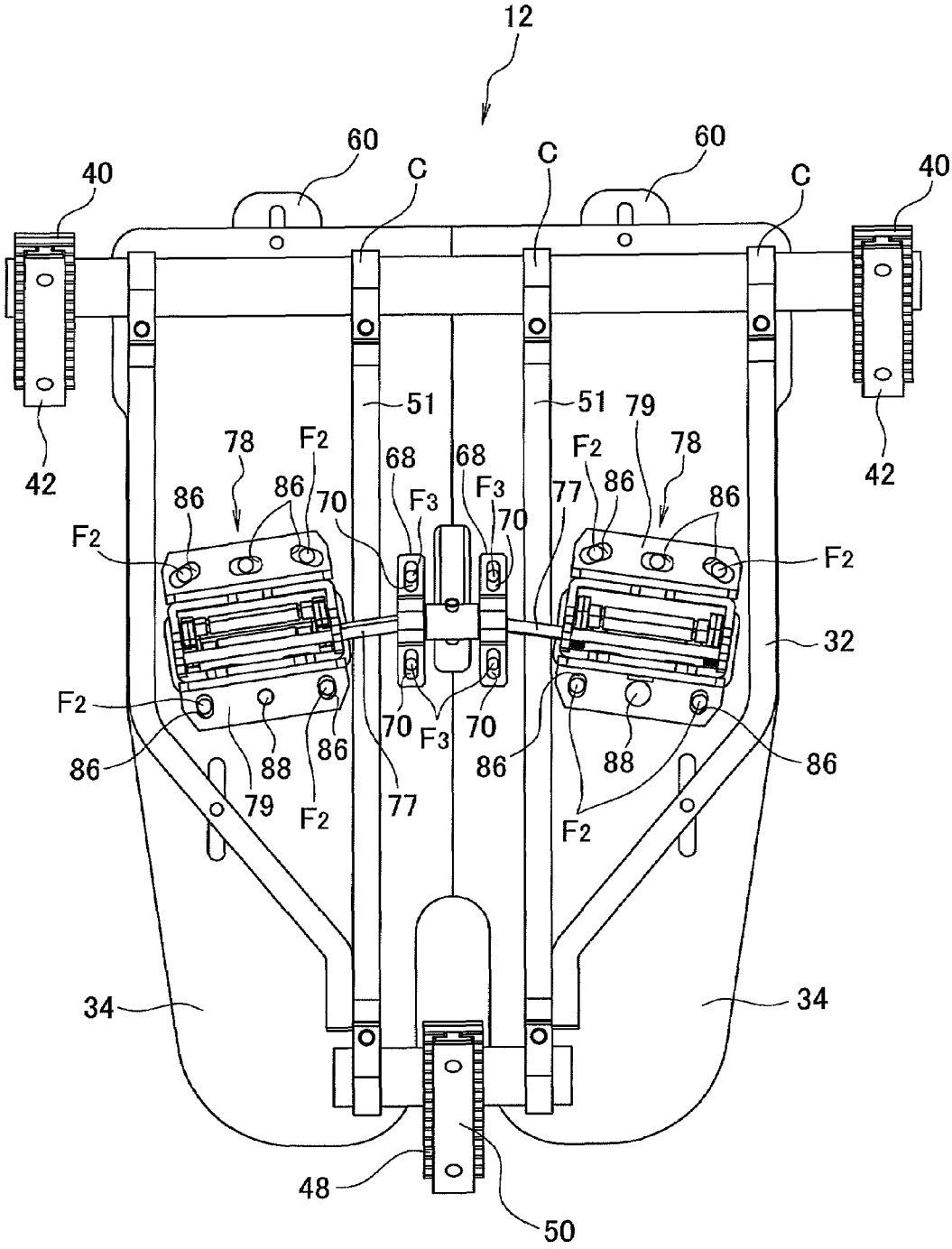
FIG. 10 is a bottom plan view of an underside of the footrest assembly showing features of the lever release mechanism in accordance with the present invention.

The inclined support member 32 is a U-shaped member with two generally parallel portions that have upper ends fixedly attached to the lateral support member 30 by clamping assemblies C (shown in FIGS. 2-5). A lower end of the inclined support member 32 includes a gripping block 48 similar to the gripping blocks 40. Further, the middle rail 22*b* includes a track 50 with gear teeth. As with the gripping blocks 40 of the lateral support member 30, the gripping block 48 of the inclined support member 32 is engagable with the track 50 on the middle rail 22*b* for positioning the footrest assembly 12 relative to the support structure 16. As shown in FIG. 10, the inclined support member 32 also includes bars 51 that extend between the lateral support member 30 and the gripping block 48. Although not shown, the gripping block 48 can further include a clamping element or fastener for selectively securing the gripping blocks 48 to the middle rail 22*b* once the footrest assembly 12 is positioned in the desired location.

It should be understood from the drawings and the description herein that although the inclined support member 32 has a U-shape, alternative shapes and configurations can be used for the inclined support member 32. For example, the inclined support member 32 can have a V-shape, or can be a flat member welded to or otherwise extending from the lateral support member 30. Alternatively, the lateral support member 30 and the inclined support member 32 can be formed as a single unitary element that has an overall planar configuration.

The footrest plates 34 basically constitute a stationary footrest surface coupled to hull 14 of the rowing boat 10 (the boat structure). The footrest plates 34 are depicted as two separate elements but can alternatively be made as a single footrest plate that is dimensioned to receive two shoes S. However in the depicted embodiment, there are two of the footrest plates 34. The footrest plates 34 are secured to the inclined support member 32 and the bars 51 by fasteners $F_1$ that extend through the slots 52. The slots 52 and the fasteners $F_1$ are provided to allow the footrest plates 34 to be horizontally adjustably secured to the inclined support member 32. In other words, the rower R can adjust the horizontal position of the footrest plates 34 to suit his or her needs. Further, the footrest plates 34 are configured to allow for angular adjustment of elements of the lever release mechanism 36, as described in greater detail below.

Figure 6:
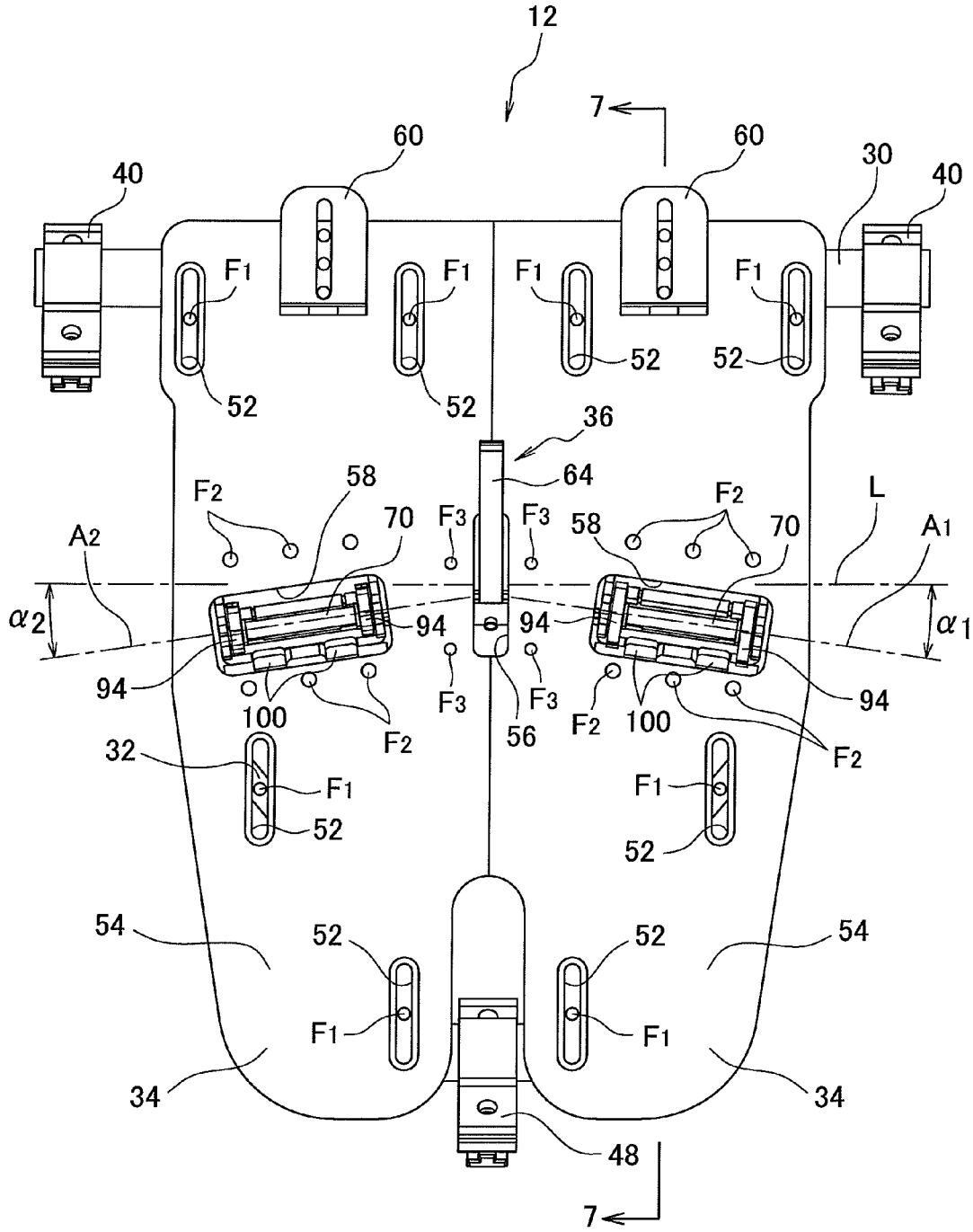
FIG. 6 is a top plan view of the footrest assembly showing a control lever of a lever release mechanism that is operably connected to the shoe attachment portions in accordance with the present invention.

Each of the footrest plates 34 defines a footrest surface 54. The rower's shoes S contact and can press against the footrest surface 54 providing leverage for the rower R when rowing. The footrest plates 34 are further dimensioned with respective gaps that together define a lever receiving opening 56, as described below. The footrest plates 34 further include openings 58, as best shown in FIG. 6. The openings 58 are symmetrically arrange with one another in a manner described in greater detail below. Adjustable toe stops 60 are also included on each of the footrest plates 34. The toe stops 60 are mainly provided to assist the rower R in positioning his or her shoes S on the footrest plates 34.

Figure 11:
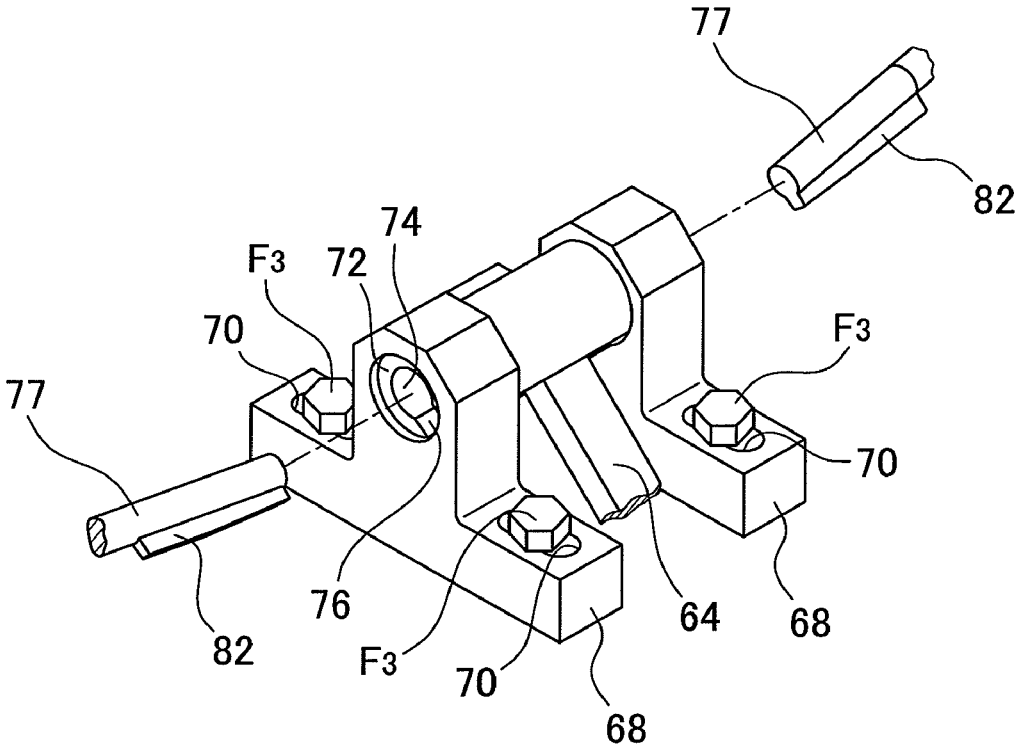
FIG. 11 is a perspective view of a portion of the lever release mechanism show a shaft structure thereof in accordance with the present invention.
Figure 12:
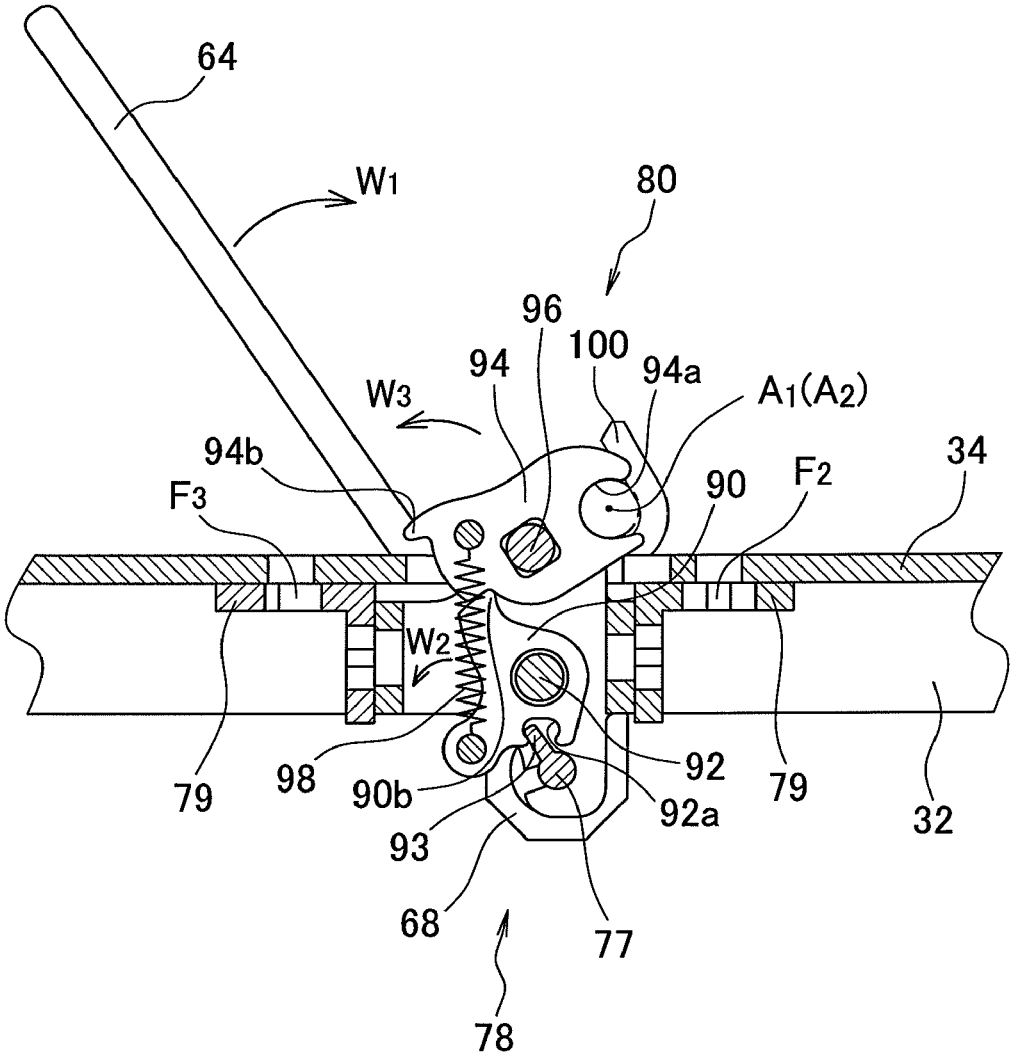
FIG. 12 is a side cross-sectional view of the lever release mechanism showing portions of first and second cam members of the lever release mechanism in accordance with the present invention.

As best shown in FIGS. 2 and 6-11, the lever release mechanism 36 includes a control lever 64 and a pair of shoe attachment mechanisms 66 (shoe attachment portions) that are operated by the control lever 64. As shown in FIGS. 10, 11 and 12, the control lever 64 is pivotally supported by a pair of support brackets 68 that include oblong apertures 70. Fasteners $F_3$ extending through apertures in the footrest plates 34 further extend through the oblong apertures 70 of the support brackets 68. Thus, the position of the brackets 68 relative to the footrest plates 34 can be adjusted, as described in greater detail below. A lower end of the control lever 64 includes a shaft portion 72 that extends through bearing support openings of the support brackets 68. The shaft portion 72 is includes a central opening 74 formed with recesses or keyways 76.

The shoe attachment mechanisms 66 are generally the same, but are installed under respective ones of the footrest plates 34 on opposite sides of the control lever 64. The shoe attachment mechanisms 66 are similar to conventional shoe attachment mechanisms such as those used in snowboarding and related action sports. For example, such conventional shoe attachment mechanisms are disclosed in U.S. Pat. Nos. 6,467,795 and 6,871,869 (both assigned to Shimano Inc.). In such conventional shoe attachment mechanisms, a single lever operates a single shoe attachment mechanism. However, in the illustrated embodiment, movement of the control lever 64 operates both of the shoe attachment mechanisms 66 simultaneously in a manner described below. Since the shoe attachment mechanisms 66 are the same and operate in the same manner, a description of only one of the shoe attachment mechanism 66 is provided for the sake of brevity. However the description of one shoe attachment mechanism 66 applies to both.

As best shown in FIGS. 6-8 and 10-12, each of the shoe attachment mechanisms 66 basically includes a shaft 77, an operating mechanism portion 78 and a shoe attachment portion 80. There are two shoe attachment mechanisms 66. However, description of only one is provided for the sake of brevity.

Figure 7:
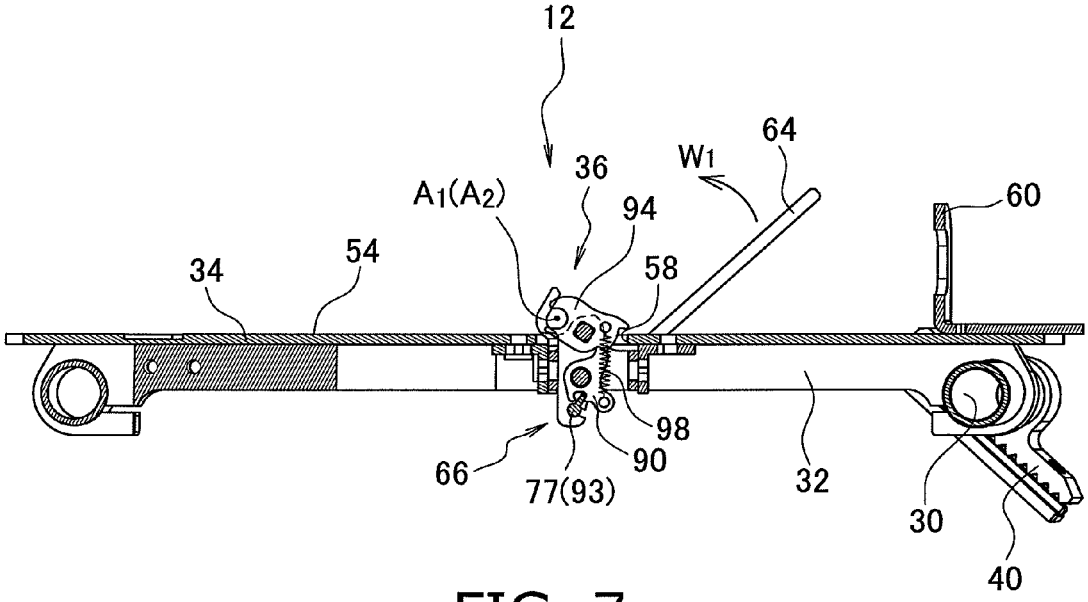
FIG. 7 is a side cross-sectional view of the footrest assembly taken along the line 7-7 in FIG. 6 showing details of the lever release mechanism and one of the shoe attachment portions with the lever release mechanism in a shoe retaining orientation in accordance with the present invention.
Figure 8:
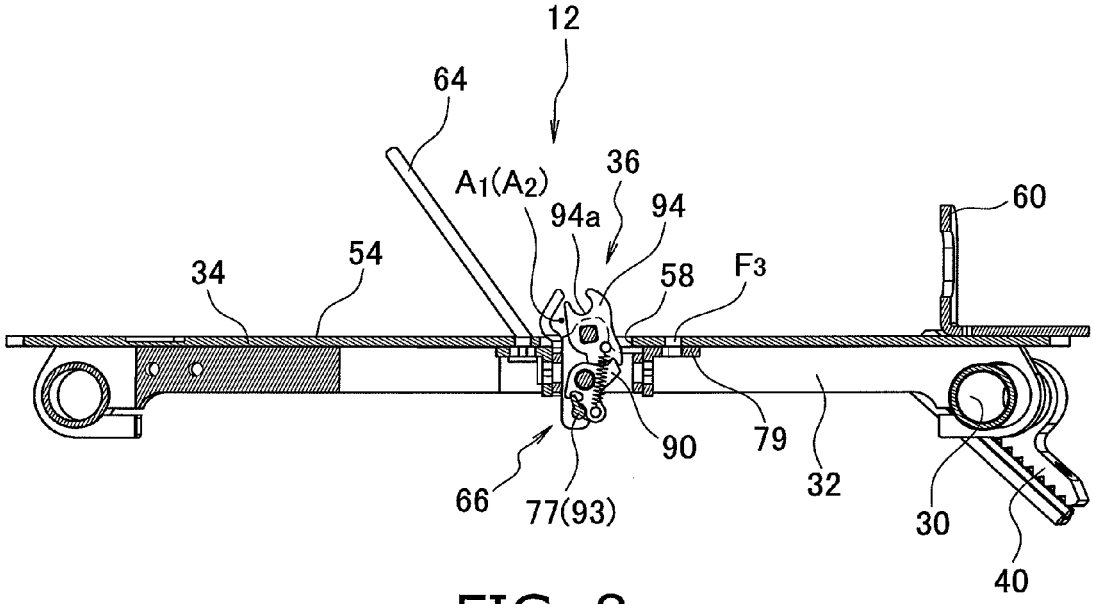
FIG. 8 is another side cross-sectional view of the footrest assembly, similar to FIG. 7, showing further details of the lever release mechanism and one of the shoe attachment portions with the lever release mechanism in a shoe releasing orientation in accordance with the present invention.
Figure 9:
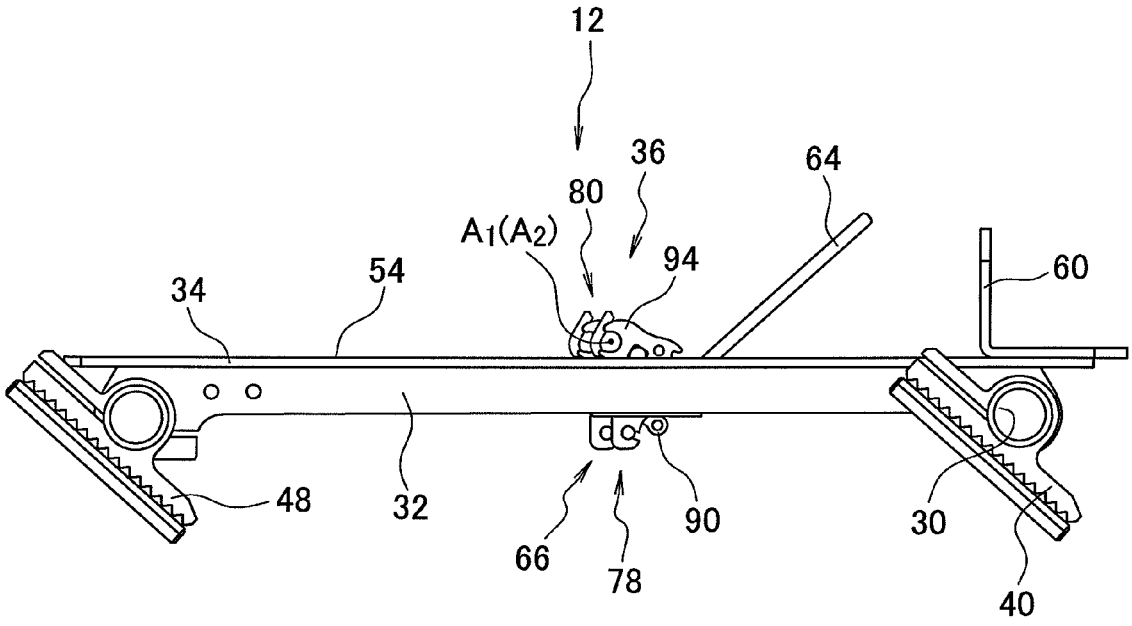
FIG. 9 is a side elevational view showing details of the footrest assembly in accordance with the present invention

As best shown in FIGS. 7, 8 and 10, the control lever 64 is operably connected to the operating mechanism portion 78 such that movement of the control lever 64 causes the operating mechanism portion 78 to move between a shoe retaining orientation shown in FIG. 7 and a shoe releasing orientation shown in FIG. 8. This movement is made possible by the shaft 77 which includes a keyway projection 82. The keyway projection 82 and the shaft 74 are tapered such that they extend loosely into the opening 74 of the shaft portion 72 of the control lever 64. The keyway projection 82 further loosely extends into the keyway 76 of the opening 74. Since the shaft 77 and keyway projection 82 are tapered, there is a predetermined amount of play between the shaft 77 and the shaft portion 72 of the control lever 64, as described further below.

The operating mechanism portion 78 and the shoe attachment portion 80 are integrally formed as a single mechanism for each foot. However, the operating mechanism portion 78 is located on an underside of the footrest plate 34 and the shoe attachment portion 80 extends through the opening 58 of the footrest plate 34. As shown in FIG. 10, each of the operating mechanism portions 78 includes a pair L-shaped fixing members 79 with five oblong apertures 86 (three on one of the L-shaped fixing members 79 and two on the other of the L-shaped fixing members 79) and one round aperture 88. The operating mechanism portions 78 are fixed to the underside of the footrest plate 34 via fasteners $F_2$ (shown in FIGS. 6 and 10) that extend through the apertures 86 and 88.

As best understood in FIG. 10, the aperture 88 and corresponding fastener $F_2$ serve as a pivot point when adjusting the angular position of the operating mechanism portion 78 and the shoe attachment portion 80. Specifically, the operating mechanism portion 78 and the shoe attachment portion 80 are able to selectively pivot about the aperture 88 with all of the fasteners $F_2$ loosened. Pivoting movement or angular adjustment of the operating mechanism portion 78 and the shoe attachment portion 80 is limited by the dimensions of the oblong apertures 86.

With specific reference now to FIGS. 2, 7, 8 and 12, a further description of the operating mechanism portion 78 and the shoe attachment portion 80 is provided. The operating mechanism portion 78 includes a first cam member 90 that pivots about a shaft 92. Only one first cam member 90 is depicted in FIGS. 7, 8 and 12, but it should be understood from the drawings and the description that the illustrated embodiment can be modified to include two of the first cam members 90 in each of the shoe attachment mechanisms 66. The first cam member 90 includes a recess **90*a* and a projection or cam 90*b*. The first cam member 90 is operated by a lever 93 that is rigidly fixed to the end of the shaft 77. Specifically, lever 93 extends into the recess 90*a* of the first cam member 90. When the shaft 77 and lever 93 are rotated, the first cam member 90** can move, as described in greater detail below.

The shoe attachment portion 80 further includes a pair of second cam members 94 that are both fixed to a shaft 96 and rotate together as a single unit or element. The second cam members 94 are biased toward the shoe releasing orientation shown in FIG. 8 by a spring 98 that is attached between the first cam member 92 and one of the second cam members 94. It should be noted that both of the second cam members 94 are depicted in FIG. 2. However only one of the second cam members 94 is depicted in FIGS. 7, 8 and 12. Each of the second cam members 94 further includes a recess **94*a* and a projection or cam 94*b***.

The shoe attachment portion 80 of the shoe attachment mechanism 66 further includes a pair of fixed bar member 100 that are best shown in FIG. 2. The fixed bar members 100 and the recesses **94*a* of the second cam members 94** cooperate with one another to retain the shoe S as described in greater detail below.

Operation of the lever release mechanism 36 and the shoe attachment mechanisms 66 is now explained with specific reference to FIGS. 7, 8 and 12. As mentioned above, the lever release mechanism 36 is depicted in the shoe retaining orientation in FIG. 7. FIG. 12 also shows the lever release mechanism 36 in the shoe retaining orientation, but from a reverse angle. FIG. 8 shows the lever release mechanism 36 in the shoe releasing orientation.

When the control lever 64 is moved in the direction of the arrow $W_1$ from the shoe retaining orientation shown in FIGS. 7 and 12 toward the shoe releasing orientation shown in FIG. 8, the lever 93 (fixed to the control lever 64) moves within the recess **90*a* of the first cam member 90. With the first cam member 90 in the shoe retaining orientation, the lever 93 contacts a surface within the recess 90*a* causing the first cam member 90 to move in the direction corresponding to the arrow $W_2$. As the first cam member 90 moves in the direction corresponding to the arrow $W_2$, the cam 90*b* moves away from the second cam member 94. The biasing force of the spring 98 urges the second cam member 94** to move in the direction corresponding to the arrow $W_3$.

Thereafter, the second cam member 94 remains in the shoe releasing orientation depicted in FIG. 8 until a shoe S is installed on the footrest assembly 12. Because of the recess **90*a* of the first cam member 90, the control lever 64 can be moved back to the shoe retaining orientation, while the second cam member 94 remains in the cam release orientation. The second cam member 94** can only return to the shoe retaining orientation when urged manually to do so.

Figure 3:
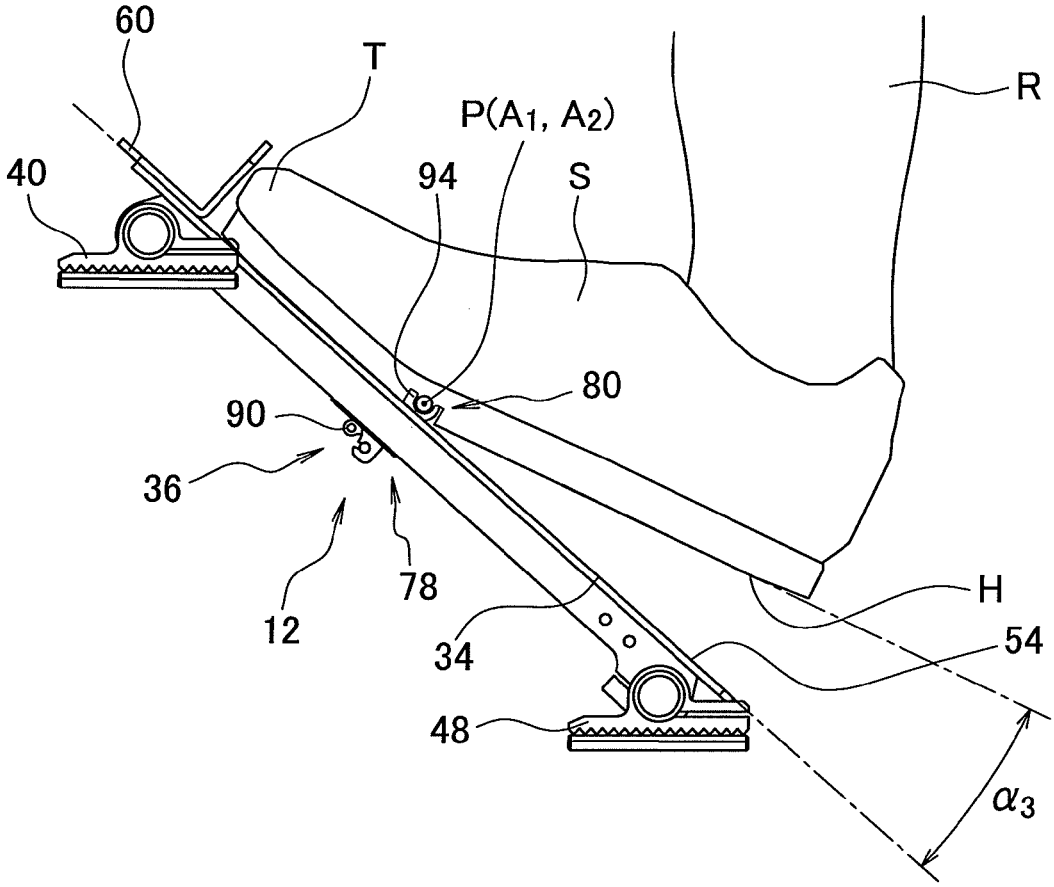
FIG. 3 is a side elevational view of the footrest assembly showing one of the rower's shoes in a rowing position retained by the shoe attachment portion and pivoted to a first pivot position with a heel portion of the shoe pivoted upward and away from the shoe contacting surface during the rowing motion in accordance with the present invention.
Figure 4:
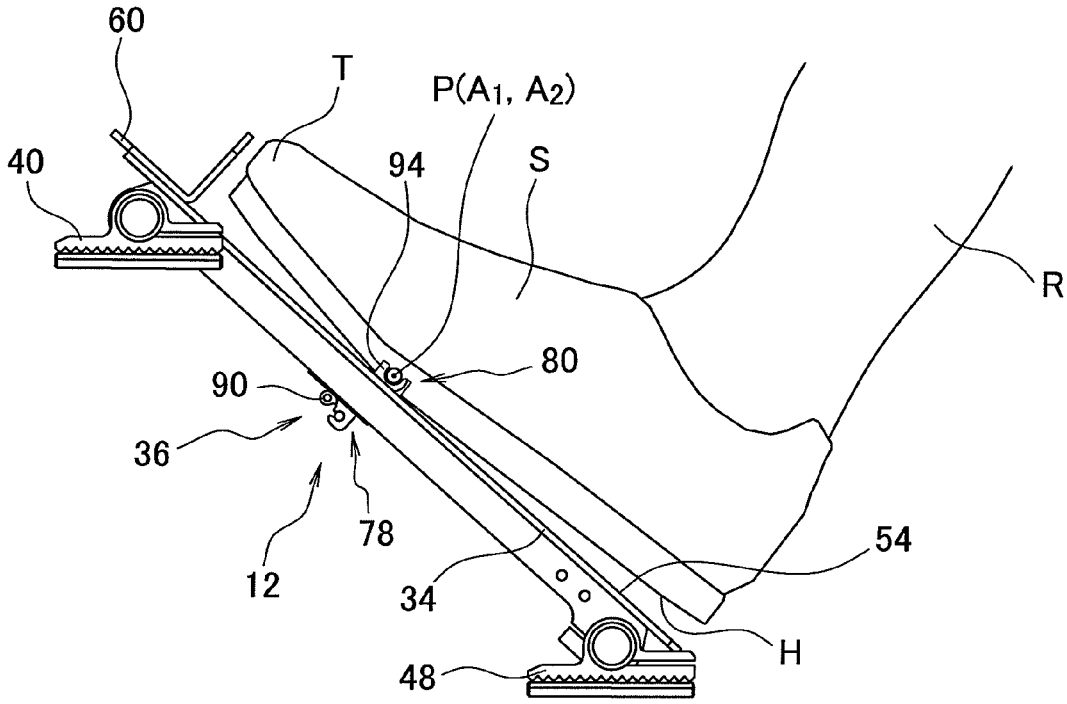
FIG. 4 is another side elevational view of the footrest assembly showing the rower's shoes retained by the shoe attachment portion and pivoted to intermediate pivot position such that the heel portion of the shoe is pivoted only part way away from the shoe contacting surface in accordance with the present invention.
Figure 5:
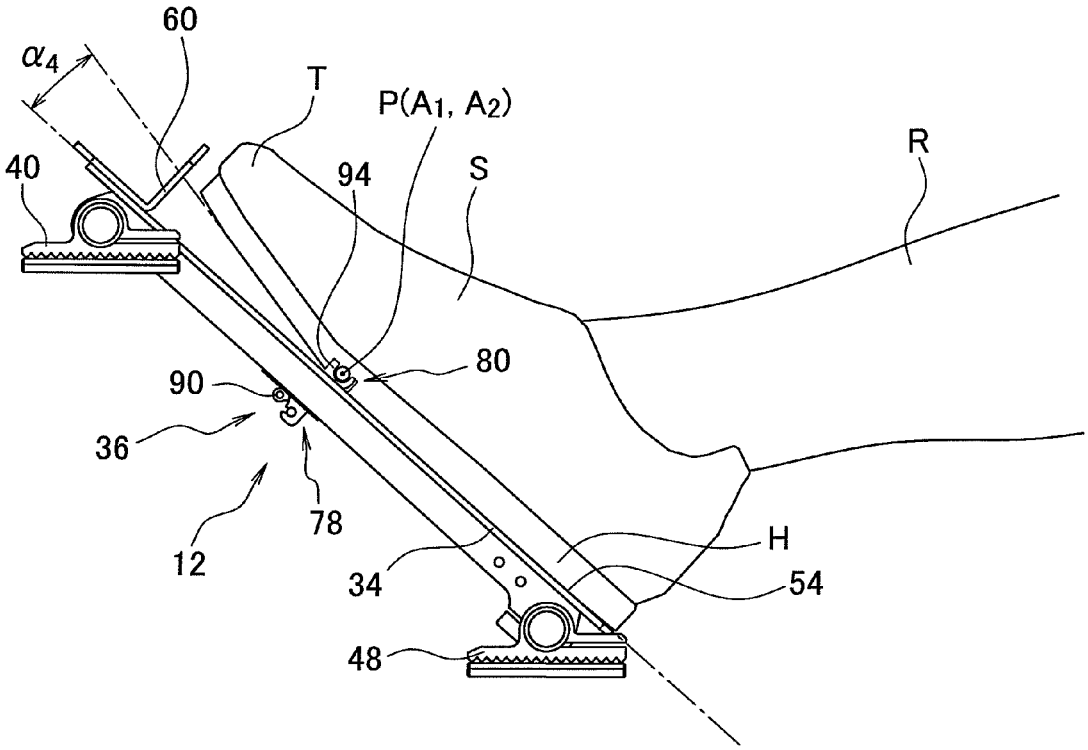
FIG. 5 is still another side elevational view of the footrest assembly showing the rower's shoes retained by the shoe attachment portion and pivoted such that the heel portion of the shoe contacts the shoe contacting surface in accordance with the present invention.

Specifically, when a shoe S is installed on the footrest assembly 12, a pin P of the shoe S (the pin P is shown in FIGS. 3-5) contacts the recess **94*a* of the second cam member 94. Pressing force applied by a rower R on the shoe S causes the second cam member 94 to overcome the biasing force of the spring 98. Once the second cam member 94 is restored to the shoe retaining orientation, the first cam member 90 also returns to the shoe retaining orientation shown in FIGS. 7 and 12**.

Returning now to FIGS. 6 and 7, the shoe attachment portions 80 define axes $A_1$ and $A_2$ (only axis $A_1$ is shown in FIG. 7). The axes $A_1$ and $A_2$ are both spaced apart and above the footrest surface 54, as best shown in FIGS. 3-5, 7 and 8. Hence, the shoe attachment portions 80 are thereby supported to the footrest surface 54 and are configured to releasably retain the shoes S for pivotal movement about axes $A_1$ and $A_2$ relative to the footrest surface 54.

As best shown in FIG. 2, the axes $A_1$ and $A_2$ are co-planar. In other words, the axes $A_1$ and $A_2$ lie in the same plane that is preferably parallel to the footrest surface 54. As best shown in FIG. 6, the axes $A_1$ and $A_2$ are angularly offset from one another and symmetrical arranged with respect to one another about a horizontal line L extending laterally along the footrest surface 54 (and between the two footrest plates 34).

Specifically, the axis $A_1$ is an axis angularly offset from the horizontal line L by an angle $\alpha_1$ of between 4.5 and 12.5 degrees measured in one of a clockwise relative to FIG. 6. However, in a preferred embodiment, the axis $A_1$ is axis angularly offset from the horizontal line L where the angle $\alpha_1$ is 8.5 degrees. The axis $A_2$ is angularly offset from the horizontal line L by an angle $\alpha_2$ of between 4.5 and 12.5 degrees measured in the counter clockwise direction relative to FIG. 6. However, in a preferred embodiment, the axis $A_2$ is axis angularly offset from the horizontal line L where the angle $\alpha_2$ is 8.5 degrees. It should be understood from the drawings and the description herein that the angles described above can be fine tuned and adjusted by loosening the fasteners $F_2$. With the fasteners $F_1$ loosened, the position of the footrest plates 34 can be adjusted since the fasteners $F_1$ extend through the slots 52. Hence, the position of the footrest plates 34 can be adjusted, thereby adjusting the positions of the axes $A_1$ and $A_2$ (the pivot axes).

The angles $\alpha_1$ and $\alpha_2$ can be adjusted. Specifically, the fasteners $F_2$ can be loosened such that the operating mechanism portion 78 and the shoe attachment portion 80 can be angularly displaced about the round aperture 88 (see FIG. 10). Since the shaft 77 and the keyway projections 82 are tapered, they provide play such that the angles $\alpha_1$ and $\alpha_2$ of the two operating mechanism portions 78 and the shoe attachment portions 80 can be adjusted within the ranges set forth above without interference from the shaft 77.

The shoes S of the rower R each include a heel portion H, a toe portion T and a pin P that is retained within a sole portion of the shoe S. The pin P is non-releasably retained or imbedded in the shoe S such that with the pin P installed in the shoe attachment portion 80, the shoe S can be secured to the footrest assembly 12. More specifically, the rower R puts his or her shoes S on the footrest surface 54 with the control lever 64 in the shoe release orientation (FIG. 8). The rower R adjusts the position of the shoes S until the pins P are positioned within the shoe attachment portion 80 of the shoe attachment mechanisms 66. Then the rower moves the control lever 64 to the shoe retaining orientation (FIG. 7). Once the pins P are secured in the shoe attachment portion 80, the pins P coincide with respective ones of the axes $A_1$ and $A_2$ (first and second pivot axis). The shoes S are now pivotally retained by the shoe attachment mechanism 66 such that the shoes S pivot about respective ones of the axes $A_1$ and $A_2$ (first and second pivot axes).

The pivoting movement of the shoes S about the axes $A_1$ and $A_2$ is best shown in FIGS. 3, 4 and 5. As shown in FIG. 3, the shoe S can pivot such that the heel portions H of the shoes S are pivotal about the axes $A_1$ and $A_2$ relative to the footrest surface 54 by an angle $\alpha_3$ of between 11 and 25 degrees. As shown in FIG. 5, with the heel portion H resting on the footrest surface 54, the toe portion T of the shoe S can be angularly displaced from the footrest surface 54 by an angle $\alpha_4$ of between 8 and 14 degrees.

The footrest assembly 12 of the illustrated embodiment provides a simple and reliable way of retaining the shoes S in order to provide leverage for a rower R rowing the rowing boat 10. Further, since the axes $A_1$ and $A_2$ are angularly displaced or offset from one another, the rower R has a more ergonomic arrangement for his or her feet while rowing.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the present invention, the following directional terms "above, downward, vertical, horizontal, below and transverse" as well as any other similar directional terms refer to those directions of a rowing boat equipped with the present invention. Accordingly, these terms, as utilized to describe the present invention should be interpreted relative to a rowing boat equipped with the present invention as used in the normal rowing position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A rowing boat footrest assembly comprising:

a stationary footrest surface coupled to a boat structure;

a first shoe attachment portion supported to the footrest surface for releasably retaining a first shoe for pivotal movement about a first pivot axis relative to the footrest surface; and a second shoe attachment portion supported to the footrest surface for releasably retaining a second shoe for pivotal movement about a second pivot axis relative to the footrest surface, with the first pivot axis and the second pivot axis being co-planar and angularly offset from one another.

2. The row boat footrest assembly according to claim 1, wherein the first pivot axis and the second pivot axis are symmetrical arranged with respect to one another about a horizontal line extending laterally along the footrest surface.

3. The row boat footrest assembly according to claim 2, wherein the first pivot axis is angularly offset from the horizontal line by an angle of between 4.5 and 12.5 degrees measured in one of a clockwise and a counter clockwise directions, and the second pivot axis is angularly offset from the horizontal line by an angle of between 4.5 and 12.5 degrees measured in the other of the clockwise and the counter clockwise directions.

4. The row boat footrest assembly according to claim 3, wherein the first pivot axis is angularly offset from the horizontal line by an angle of 8.5 degrees, and the second pivot axis is angularly offset from the horizontal line by an angle of 8.5 degrees.

5. The row boat footrest assembly according to claim 1, wherein the first and second pivot axes are located above the footrest surface.

6. The row boat footrest assembly according to claim 1, wherein the first and second shoe attachment portions are configured and arranged such that the first and second shoes are pivotal about the first and second pivot axes relative to the footrest surface by an angle between 11 and 25 degrees.

7. The row boat footrest assembly according to claim 1, wherein the first and second shoe attachment portions include a lever release mechanism configured to selectively release the first and second shoes.

8. The row boat footrest assembly according to claim 1, wherein the first pivot axis is angularly offset from a horizontal line extending laterally along the footrest surface by an angle of between 4.5 and 12.5 degrees measured in one of a clockwise and a counter clockwise directions, and the second pivot axis is angularly offset from the horizontal line by an angle of between 4.5 and 12.5 degrees measured in the other of the clockwise and the counter clockwise directions.

9. The row boat footrest assembly according to claim 8, wherein the first pivot axis is angularly offset from the horizontal line by an angle of 8.5 degrees, and the second pivot axis is angularly offset from the horizontal line by an angle of 8.5 degrees.

10. The row boat footrest assembly according to claim 8, wherein the first and second pivot axes are located above the footrest surface.

11. A rowing boat footrest assembly comprising:

a stationary footrest surface coupled to a boat structure;

a first shoe attachment portion supported to the footrest surface for releasably retaining a first shoe for pivotal movement about a first pivot axis relative to the footrest surface;

a second shoe attachment portion supported to the footrest surface for releasably retaining a second shoe for pivotal movement about a second pivot axis relative to the footrest surface, and a lever release mechanism having a single lever movable between a shoe retaining position and a shoe releasing position operably coupled to operate both the first shoe attachment portion and the second shoe attachment portion simultaneously.

12. The row boat footrest assembly according to claim 11, wherein the first pivot axis and second pivot axis are co-planar and angularly offset from one another.

13. The row boat footrest assembly according to claim 11, wherein the first and second pivot axes are located above the footrest surface.

14. The row boat footrest assembly according to claim 11, wherein the first and second shoe attachment portions are configured and arranged such that the first and second shoes are pivotal about the first and second pivot axes relative to the footrest surface by an angle between 11 and 25 degrees.

15. The row boat footrest assembly according to claim 11, wherein the first pivot axis is angularly offset from a horizontal line extending laterally along the footrest surface by an angle of between 4.5 and 12.5 degrees measured in one of a clockwise and a counter clockwise directions, and the second pivot axis is angularly offset from the horizontal line by an angle of between 4.5 and 12.5 degrees measured in the other of the clockwise and the counter clockwise directions.

16. The row boat footrest assembly according to claim 15, wherein the first pivot axis is angularly offset from the horizontal line by an angle of 8.5 degrees, and the second pivot axis is angularly offset from the horizontal line by an angle of 8.5 degrees.

* * * * *